US008785093B2

(12) United States Patent
Sawada et al.

(10) Patent No.: US 8,785,093 B2
(45) Date of Patent: Jul. 22, 2014

(54) IMAGE FORMING TONER, AND DEVELOPER AND PROCESS CARTRIDGE USING THE TONER

(75) Inventors: Toyoshi Sawada, Hiraisuka (JP); Tomomi Suzuki, Numazu (JP); Tsuneyasu Nagatomo, Numazu (JP); Satoshi Kojima, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 817 days.

(21) Appl. No.: 12/260,493

(22) Filed: Oct. 29, 2008

(65) Prior Publication Data

US 2009/0142093 A1 Jun. 4, 2009

(30) Foreign Application Priority Data

Nov. 30, 2007 (JP) ..... 2007-310088
Nov. 30, 2007 (JP) ..... 2007-310978

(51) Int. Cl.
*G03G 9/00* (2006.01)

(52) U.S. Cl.
USPC ..... 430/108.3; 430/108.1

(58) Field of Classification Search
USPC ..... 399/111; 430/108.1, 108.3
See application file for complete search history.

(56) References Cited

U.S. PATENT DOCUMENTS 5,403,690 A 4/1995 Kuramoto et al.
5,554,478 A 9/1996 Kuramoto et al.
5,840,456 A 11/1998 Tomita et al.
6,074,794 A 6/2000 Fushimi et al.
6,303,258 B1 10/2001 Katoh et al.
6,406,826 B1 6/2002 Suzuki et al.
6,500,595 B1 12/2002 Mochizuki et al.
6,566,026 B2 5/2003 Watanabe et al.
6,653,037 B2 11/2003 Sawada et al.
6,716,561 B2 4/2004 Shiraishi et al.
6,757,507 B2 6/2004 Mochizuki et al.
6,770,411 B2 8/2004 Masuda et al.
6,818,369 B2 11/2004 Sugiura et al.
6,821,698 B2 11/2004 Sawada et al.
6,828,075 B2 12/2004 Suzuki et al.
6,830,859 B2 12/2004 Shiraishi et al.
6,852,459 B2 2/2005 Katoh et al.
6,858,365 B2 2/2005 Sawada et al.
6,861,191 B2 3/2005 Mochizuki et al.

(Continued)

FOREIGN PATENT DOCUMENTS

CN 1661494 A 8/2005
CN 1774669 A 5/2006

(Continued)

OTHER PUBLICATIONS

Office Action issued Sep. 10, 2010, in Japan Patent Application No. 2007-310088.

(Continued)

*Primary Examiner* — Stewart Fraser
(74) *Attorney, Agent, or Firm* — Oblon, Spivak, McClelland, Maier & Neustadt, L.L.P.

(57) ABSTRACT

An image forming toner, including a mother particle including a paraffin wax having a melting point of from 60 to 90° C. and a binder resin, wherein the mother particle has an endothermic peak of the paraffin wax of from 2.0 J/g to 5.5 J/g when measured by a DSC and an aspect ratio of from 0.8 to 0.90.

9 Claims, 4 Drawing Sheets

(56) References Cited

U.S. PATENT DOCUMENTS

| | | | | |
|---|---|---|---|---|
| 6,902,857 | B2 | 6/2005 | Yagi et al. | |
| 6,939,653 | B2 | 9/2005 | Suzuki et al. | |
| 6,977,129 | B2 | 12/2005 | Saito et al. | |
| 7,024,140 | B2 | 4/2006 | Masuda et al. | |
| 7,052,815 | B2 | 5/2006 | Sawada et al. | |
| 7,060,407 | B2 | 6/2006 | Nagayama et al. | |
| 7,132,210 | B2 | 11/2006 | Suzuki et al. | |
| 7,163,774 | B2 | 1/2007 | Shiraishi et al. | |
| 7,169,522 | B2 | 1/2007 | Sugiura et al. | |
| 7,217,485 | B2 | 5/2007 | Hasegawa et al. | |
| 7,235,338 | B2 | 6/2007 | Takada et al. | |
| 7,312,009 | B2 | 12/2007 | Lee et al. | |
| 7,344,812 | B2 | 3/2008 | Suzuki et al. | |
| 7,374,851 | B2 | 5/2008 | Nakayama et al. | |
| 7,379,696 | B2 | 5/2008 | Sawada et al. | |
| 7,386,266 | B2 | 6/2008 | Nagayama et al. | |
| 7,392,008 | B2 | 6/2008 | Takahashi | |
| 7,413,839 | B2 | 8/2008 | Matsumoto et al. | |
| 7,419,756 | B2 | 9/2008 | Yamashita et al. | |
| 7,429,442 | B2 | 9/2008 | Honda et al. | |
| 7,437,111 | B2 | 10/2008 | Yamada et al. | |
| 2002/0025184 | A1* | 2/2002 | Ishikawa et al. | 399/111 |
| 2005/0112488 | A1 | 5/2005 | Yamada et al. | |
| 2006/0024097 | A1 | 2/2006 | Yamada et al. | |
| 2006/0063081 | A1 | 3/2006 | Nagatomo et al. | |
| 2006/0222987 | A1 | 10/2006 | Suzuki et al. | |
| 2007/0218381 | A1 | 9/2007 | Uchinokura et al. | |
| 2007/0218382 | A1 | 9/2007 | Emoto et al. | |
| 2007/0218383 | A1 | 9/2007 | Seshita et al. | |
| 2007/0218385 | A1 | 9/2007 | Kojima et al. | |
| 2007/0218387 | A1 | 9/2007 | Ishii et al. | |
| 2007/0275315 | A1 | 11/2007 | Nagatomo et al. | |
| 2008/0069616 | A1 | 3/2008 | Kojima et al. | |
| 2008/0070144 | A1 | 3/2008 | Nagatomo et al. | |
| 2008/0070148 | A1 | 3/2008 | Awamura et al. | |
| 2008/0076055 | A1 | 3/2008 | Sawada et al. | |
| 2008/0090165 | A1 | 4/2008 | Yamada et al. | |

FOREIGN PATENT DOCUMENTS

| | | | |
|---|---|---|---|
| CN | 1869834 | A | 11/2006 |
| EP | 1 973 004 | A1 | 9/2008 |
| JP | 2003-177568 | A | 6/2003 |
| JP | 2005-227672 | A | 8/2005 |
| JP | 2006-330457 | | 12/2006 |
| JP | 2007-241088 | A | 9/2007 |
| JP | 2007-248982 | | 9/2007 |
| JP | 2007-279685 | | 10/2007 |
| JP | 2007-279714 | | 10/2007 |
| JP | 2008-233427 | | 10/2008 |

OTHER PUBLICATIONS

Chinese Office Action issued Mar. 11, 2011, in Patent Application No. 200810177821.7.

Japanese Office Action issued on Jan. 24, 2011 in corresponding Japanese Application No. 2007-310978, filed on Nov. 30, 2007.

Presentation of Publications and the Like submitted to the Commissioner of the Japanese Patent Office on Jan. 22, 2011 in Japanese Application No. 2007-310978 (with an English Translation).

Japanese Office Action issued Aug. 2, 2011, in Patent Application No. 2007-310978.

Office Action issued Dec. 29, 2011, in Chinese Patent Application No. 200810177821.7.

* cited by examiner

IMAGE FORMING TONER, AND DEVELOPER AND PROCESS CARTRIDGE USING THE TONER

BACKGROUND OF THE INVENTION

1. Field of the Invention

The present invention relates to a toner for developing an electrostatic latent image in electrophotography, electrostatic recording and electrostatic printing, and to a developer and a process cartridge using the toner.

2. Discussion of the Background

Recent strong demands from the market for higher quality image and energy saving accelerate developing suitable toners and developers therefor. The suitable toner essentially needs to have a small particle diameter and a sharp particle diameter distribution. Individual toner particles having a sharp particle diameter distribution uniformly behave when developing and eminently improve fine dot reproducibility. As a method of preparing such a toner having a sharp particle diameter distribution, polymerization methods such as a suspension polymerization method, an emulsion polymerization method easily deforming toners and a solution suspension method are being used recently.

In order to fix a toner at a lower temperature, a polyester resin having good low-temperature fixability and thermostable preservability is now being used as a binder resin instead of styrene-acrylic resins having conventionally been used. In order to further improve the low-temperature fixability, thermal properties of the resin need controlling. When the resin has too low a glass transition temperature (Tg), the thermostable preservability of the resultant toner deteriorates. When the resin has too low a softening point [T (F½)], hot offset occurrence temperature of the resultant toner lowers. Therefore, even the polyester resin has not yet prepared a toner having good low-temperature fixability and a high hot offset occurrence temperature. Further, since developers in copiers producing images for a long time are stirred for long periods, release agents and polyester resins having a low melting point in toners adhere to carriers, resulting in deterioration of chargeability of the carrier and charge amount of the developer.

Since silica as a fluidizer does not adhere well and moves to concavities of a toner having concavities and convexities, the toner is likely to contaminate a photoreceptor and adhere to a fixing roller. Although having a merit of using a low-temperature fixable polyester resin, the solution suspension method adds a polymeric material in a solution or a dispersion of a resin and a colorant to improve releasability of the resultant toner so as to be an oilless fixable toner. Therefore, the solution or the dispersion has high viscosity and likely to lower the productivity. Japanese published unexamined application No. 9-15903 discloses a method of preparing a toner a developing an electrostatic latent image, including a process of mixing a binder resin and a colorant in a solvent which is not miscible with water to prepare a composition, a process of dispersing the composition in an aqueous medium under the presence of a dispersion stabilizer to prepare a suspension, a process of removing the solvent from the suspension upon application of heat and/or depressure to form particles having concave and convex surfaces and a process of spheronizing or deforming the particles. However, the resultant irregular-formed toner us unstably charged and is not designed to be polymeric to have basic durability and releasability.

Because of these reasons, a need exists for a toner having a small particle diameter and a sharp particle diameter distribution to produce high-definition images having good fine dot reproducibility, good hot offset resistance, low-temperature fixability, and no deterioration of chargeability adhering less to a carrier even when used for long periods.

SUMMARY OF THE INVENTION

Accordingly, an object of the present invention is to provide a toner having a small particle diameter and a sharp particle diameter distribution to produce high-definition images having good fine dot reproducibility, good hot offset resistance, low-temperature fixability, and no deterioration of chargeability adhering less to a carrier even when used for long periods.

Another object of the present invention is to provide a developer including the toner.

A further object of the present invention is to provide a process cartridge using the toner.

Another object of the present invention is to provide an image forming apparatus using the toner.

These objects and other objects of the present invention, either individually or collectively, have been satisfied by the discovery of an image forming toner, comprising:

a mother particle, comprising:

a paraffin wax having a melting point of from 60 to 90° C.; and a binder resin, wherein the mother particle has an endothermic peak of the paraffin wax of from 2.0 J/g to 5.5 J/g when measured by a DSC and an aspect ratio of from 0.8 to 0.90.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
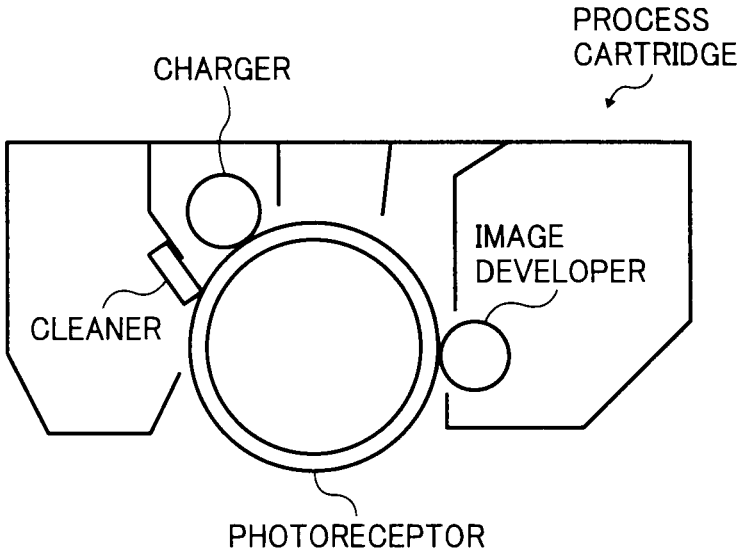
FIG. 1 is a schematic vertical cross-sectional view illustrating an embodiment of the process cartridge of the present invention.

The present invention provides a toner having a small particle diameter and a sharp particle diameter distribution to produce high-definition images having good fine dot reproducibility, good hot offset resistance, low-temperature fixability, and no deterioration of chargeability adhering less to a carrier even when used for long periods.

Particularly, the present invention relates to an image forming toner, comprising:

a mother particle, comprising:

a paraffin wax having a melting point of from 60 to 90° C.; and a binder resin, wherein the mother particle has an endothermic peak of the paraffin wax of from 2.0 J/g to 5.5 J/g when measured by a DSC and an aspect ratio of from 0.8 to 0.90.

The aspect ratio and an average circularity are measured by a flow-type particle image analyzer FPIA-3000 from SYSMEX CORPORATION and analyzed with an auxiliary analysis software. The aspect ratios and the average circularities of the particles having a diameter of from 2 to 200 μm are measured. The aspect ratios and the average circularity are defined as follows:

average circularity=a circumferential length of a circle having an area equivalent to that of a particle/a circumferential length of a particle; and aspect ratio=the maximum vertical length of a particle/the maximum length of a particle.

The average circularity mainly represents a level of concavity and convexity of a particle, and the aspect ratio mainly represents a level of spicula.

The present inventors discovered that there are the following trends (1) to (3) between the shape of a toner and charging properties thereof.

(1) The more spherical a toner, the more the toner contacts a carrier at a point. The toner contacts the carrier while rotating thereon and toner constituents such as a paraffin wax and a low-molecular-weight resin are likely to firmly fix on the carrier, resulting in deterioration of chargeability of the carrier. This occurs when a contact area between a toner and a carrier is small (two-component developing method), and when a contact area between a toner and a developing sleeve is small (one-component developing method).

(2) A toner having many concavities and convexities contacts a carrier at a surface. Although the toner is difficult to rotate on the carrier, toner constituents such as a paraffin wax and a low-molecular-weight resin are likely to firmly fix on the carrier because the contact area is large, resulting in deterioration of chargeability of the carrier. This occurs when a contact area between a toner and a carrier is large (two-component developing method), and when a contact area between a toner and a developing sleeve is large (one-component developing method).

(3) When a toner and a carrier are stirred for a long time, the shape of the toner affects more than the concavities and convexities thereof. The concavities and convexities of a toner are scarped off or deformed when the toner and a carrier are stirred in an image developer for a long time, resulting in (1).

(4) Therefore, the aspect ratio representing a level of spicula is more relationship with deterioration of the chargeability of a carrier than the average circularity representing a level of concavity and convexity of a toner. The lower the aspect ratio, the more difficult to rotate a toner on a carrier. The higher the aspect ratio, the easier to rotate a toner on a carrier because the toner is close to a sphere. Therefore, a mother toner particle preferably has an aspect ratio of from 0.80 to 0.90 such that the toner constituents are not firmly fixed on a carrier while the toner maintains a suitable contact thereto. In the meantime, the mother toner particle preferably has an average circularity of from 0.950 to 0.980. Further, the mother toner particle preferably has a shape factors SF-1 of from 130 to 160 and SF-2 of from 110 to 140.

A wax having a low melting point of from 50 to 120° C. is effectively used as a release agent. When such a wax is included in the toner, the wax is dispersed in the binder resin and serves as a release agent at a location between a fixing roller and the toner particles. Thereby, hot offset resistance can be improved without applying an oil to the fixing roller used. Particularly, a paraffin wax having a melting point of from 60 to 90° C. is preferably used.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

The release agent can be kneaded together with a masterbatch pigment and resin, and can be added when the toner constituents are dissolved or dispersed in an organic solvent.

The toner of the present invention includes a mother particle including a paraffin wax having a melting point of from 60 to 90° C. as a release agent. The mother particle has an endothermic peak of the paraffin wax of from 2.0 J/g to 5.5 J/g when measured by a DSC. The release agent is preferably used much for a toner to have hot offset resistance and preferably used less for a carrier to maintain its chargeability for long periods. From this point view, the release agent is preferably included in a toner to have an endothermic peak of from 2.0 J/g to 5.5 J/g, and more preferably from 3.5 to 5.5 J/g for the toner to have hot offset resistance and for the carrier to maintain its chargeability.

TA-60WS and DSC-60 from Shimadzu Corporation are used to measure the endothermic peak of the paraffin wax under the following conditions.

| | |
|---|---|
| Sample container: | Sample pan made of aluminum (with a lid) |
| Sample amount: | 5 mg |
| Reference: | Sample pan made of aluminum (10 mg of alumina) |
| Atmosphere: | Nitrogen (flow rate 50 ml/min) |
| Starting temperature: | 20° C. |
| Rising speed of temperature: | 10° C./min |
| Maximum temperature: | 150° C. |
| Holding time: | 0 |
| Lowering speed of temperature: | 10° C./min |
| Minimum temperature: | 20° C. |
| Holding time: | 0 |
| Rising speed of temperature: | 10° C./min |
| Maximum temperature: | 150° C. |

The measurement results are analyzed using data analysis software TA-60 version 1.52 from Shimadzu Corporation. On a DSC differential curve of the second rise of temperature, two base lines of low temperature side and high temperature side of an endothermic peak equivalent to an endotherm of a release agent when melting are fixed and the endothermic peak is determined with a peak analytical function of the analysis software. The endothermic peak equivalent to an endotherm of a release agent when melting represents all endothermic peaks. Among the plural endothermic peaks of a toner, the same endothermic peak when a release agent alone is subjected to a DSC measurement is determined as an endothermic peak of the release agent.

In addition, the glass transition temperature (Tg) of the mother particle of a toner is similarly measured. Namely, a range of ±5° C. is specified with a central focus on a maximum peak point on the lowest temperature side of a DSC differential curve in the second rise of temperature, and a peak temperature is determined using a peak analysis function of the analysis software. Next, the maximum endothermic temperature is determined of the DCS curve using the peak analysis function of the analysis software in the range of the peak temperature ±5° C. This is the glass transition temperature.

In the present invention, the mother particle of a toner typically has a Tg of from 40 to 70° C., and preferably from 40 to 60° C. When less than 40° C., the resultant toner deteriorates in its heat resistance. When higher than 70° C., the resultant toner does not have sufficient low-temperature fixability. The toner of the present invention has better thermostable preservability when including a modified polyester resin such as a urea-modified polyester resin than known polyester resins even when having a low Tg.

The mother particle of a toner preferably has a weight-average particle diameter (D4) of from 3 to 8 μm to produce images having fine dot not less than 600 dpi. A ratio of the weight-average particle diameter (D4) to a number-average particle diameter (Dn) of the mother particle of a toner is preferably from 1.00 to 1.30. The closer to 1.00, the sharper a particle diameter distribution thereof. The mother particles preferably includes particles having a diameter not greater than 2 μm in an amount of from 1 to 10% by number. Such toners having a small particle diameter and a narrow particle diameter distribution are evenly charged to produce high-definition images having less background fouling and increase developing efficiency of electrostatic transfer methods. However, such a toner nonelectrostatically adheres more to a carrier than a toner having a large particle diameter. The toner stays long on the surface of the carrier, and is likely to receive a stirring stress and firmly fixed thereon to deteriorate the chargeability of the carrier. Therefore, the mother particles preferably includes particles having a diameter not greater than 2 μm in an amount of from 1 to 10% by number. A toner and a mother particle thereof have no difference in their diameters.

The particle diameter distribution of the toner can be measured by a Coulter counter TA-II or Coulter Multisizer II from Beckman Coulter, Inc. as follows:

0.1 to 5 ml of a detergent, preferably alkylbenzene sulfonate is included as a dispersant in 100 to 150 ml of the electrolyte ISOTON-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm, and D4 and Dn can determined therefrom.

The content of the toner particles having a diameter not greater than 2 μm is measured by a flow-type particle image analyzer FPIA-2000 from SYSMEX CORPORATION, and analyzed with a analysis software FPIA-2100 Data Processing Program for FPIA version 00-10. A specific measuring method includes stirring with a micro spatel 0.1 to 0.5 ml of a surfactant (alkylbenzenesulfonate Neogen SC-A from Daiichi Kogyo Seiyaku Co., Ltd.) having a concentration of 10% by weight with 0.1 to 0.5 g of the mother particle in a glass beaker having a capacity of 100 ml to prepare a mixture and adding 80 ml of ion-exchanged water thereto; dispersing the mixture with an ultrasonic disperser from HONDA ELECTRONICS CO., LTD. for 3 min to prepare a dispersion having a concentration of from 5,000 to 15,000 pieces/μl; and measuring the toner shape and distribution with the above-mentioned measurer. It is essential that the dispersion has a concentration of from 5,000 to 15,000 pieces/μl. Namely, the contents of the surfactant and mother particle need controlling. The content of the surfactant depends on the hydrophobicity of the mother particle. When too much, bubbles cause noises. When too little, the mother particle is not fully wetted, resulting in insufficient dispersion. The content of the mother particle depends on its particle diameter. The smaller the diameter, the less the content. The larger the diameter, the more the content. When the diameter is from 3 to 7 μm, 0.1 to 0.5 g of the mother particles are mixed to prepare a dispersion having a concentration of from 5,000 to 15,000 pieces/μl.

Most developers in full-color image forming apparatuses include toners in an amount of from 3 to 12% by weight. The toner occupies 100% or less of the surface area of a carrier This maintains sufficient contacts between the toner and the carrier to prevent the toner from being insufficiently charged. A developer having a high toner concentration is likely to have a problem of deterioration of chargeability of the carrier because a wax having a low melting point or a resin is firmly fixed on the surface thereof. However, the toner of the present invention solves these problems.

The toner of the present invention preferably includes a modified polyester (i) as a binder resin. The modified polyester (i) includes a bonding group except an ester bond or covalently-bonded or ion-bonded resins having different constitutions. Specifically, a functional group such as a carboxylic acid group and an isocyanate group reactive with a hydroxyl group is introduced to the end of polyester, and which is further reacted with a compound including an active hydrogen atom to be modified.

Specific examples of the modified polyester (i) include reaction products between polyester prepolymers (A) having an isocyanate group and amines (B). The polyester prepolymer (A) is formed from a reaction between polyester having an active hydrogen atom formed by polycondensation between polyol (PO) and a polycarboxylic acid (PC), and polyisocyanate (PIC). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

As the polyol (PO), diol (DIO) and triol (TO) can be used, and the DIO alone or a mixture of the DIO and a small amount of the TO is preferably used. Specific examples of the DIO include alkylene glycol such as ethylene glycol, 1,2-propylene glycol, 1,3-propylene glycol, 1,4-butanediol, and 1,6-hexanediol; alkylene ether glycol such as diethyleneglycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarbonate (PC), dicarboxylic acid (DIC) and tricarboxylic acid (TC) can be used. The DIC alone, or a mixture of the DIC and a small amount of the TC are preferably used. Specific examples of the DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the TC include aromatic polycarboxylic acids having 9 to 20 carbon atoms such as trimellitic acid and pyromellitic acid. PC can be formed from a reaction between the PO and the above-mentioned acids anhydride or lower alkyl ester such as methyl ester, ethyl ester and isopropyl ester.

The PO and PC are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the PIC include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as $\alpha,\alpha,\alpha',\alpha'$-tetramethylxylylenediisocyanate; isocyanurate; the above-mentioned polyisocyanate blocked with phenol derivatives, oxime and caprolactam; and their combinations.

The PIC is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When [NCO] has a molar ratio less than 1, a urea content in ester of the modified polyester decreases and hot offset resistance of the resultant toner deteriorates.

A content of the PIC in the polyester prepolymer (A) having a polyisocyanate group is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) reacted with the polyester prepolymer (A) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoronediamine); aliphatic diamines (e.g., ethylene diamine, tetramethylene diamine and hexamethylene diamine); etc. Specific examples of the polyamines (B2) having three or more amino groups include diethylenetriamine, triethylenetetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these amines (B), diamines (B1) and mixtures in which a diamine is mixed with a small amount of a polyamine (B2) are preferably used.

mixing ratio (i.e., a ratio [NCO]/[NHx]) of the content of the prepolymer (A) having an isocyanate group to the amine (B) is from ½ to 2/1, preferably from 1.5/1 to 1/1.5 and more preferably from 1.2/1 to 1/1.2. When the mixing ratio is greater than 2 or less than ½, molecular weight of the urea-modified polyester decreases, resulting in deterioration of hot offset resistance of the resultant toner.

The urea-modified polyester may include an urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

The modified polyester (i) can be prepared by a method such as a one-shot method or a prepolymer method. The weight-average molecular weight of the modified polyester (i) is not less than 10,000, preferably from 20,000 to 10,000,000 and more preferably from 30,000 to 1,000,000. When the weight-average molecular weight is less than 10,000, hot offset resistance of the resultant toner deteriorates. The number-average molecular weight of the urea-modified polyester is not particularly limited when the after-mentioned unmodified polyester resin is used in combination. Namely, the weight-average molecular weight of the modified polyester (i) has priority over the number-average molecular weight thereof when combined with an unmodified polyester (ii) mentioned later. However, when the modified polyester (i) is used alone, the number-average molecular weight is from 2,000 to 15,000, preferably from 2,000 to 10,000 and more preferably from 2,000 to 8,000. When the number-average molecular weight is greater than 20,000, the low temperature fixability of the resultant toner deteriorates, and in addition the glossiness of full color images deteriorates.

A reaction terminator can optionally be used in the crosslinking and/or elongation reaction between the (A) and (B) to control a molecular weight of the resultant urea-modified polyester. Specific examples of the reaction terminators include monoamines such as diethylamine, dibutylamine, butylamine and laurylamine; and their blocked compounds such as ketimine compounds.

In the present invention, an unmodified polyester resin (ii) can be used in combination with the modified polyester resin (i) as a toner binder resin. It is more preferable to use the unmodified polyester resin (ii) in combination with the modified polyester resin than to use the modified polyester resin alone because a low-temperature fixability and a glossiness of full color images of the resultant toner improve. Specific examples of the unmodified polyester resin (ii) include polycondensated products between the polyol (PO) and polycarboxylic acid (PC) similarly to the modified polyester resin (i), and products preferably used are the same as those thereof. The unmodified polyester (ii) can be substituted with another modified polyester other than a urea-modified polyester such as a urethane-modified polyester. It is preferable that the modified polyester resin (i) and unmodified polyester resin (ii) are partially soluble each other in terms of the low-temperature fixability and hot offset resistance of the resultant toner. Therefore, the modified polyester resin (i) and unmodified polyester resin (ii) preferably have similar compositions. When the unmodified polyester resin (ii) is used in combination, a weight ratio ((i)/(ii)) between the modified polyester resin (i) and unmodified polyester resin (ii) is from 5/95 to 75/25, preferably from 10/90 to 25/75, more preferably from 12/88 to 25/75, and most preferably from 12/88 to 22/78. When the modified polyester resin (i) has a weight ratio less than 5%, the resultant toner has a poor hot offset resistance, and has a difficulty in having a thermostable preservability and a low-temperature fixability.

The unmodified polyester resin (ii) preferably has a peak molecular weight of from 1,000 to 10,000, preferably from 2,000 to 8,000, and more preferably from 2,000 to 5,000. When less than 1,000, the thermostable preservability of the resultant toner deteriorates. When greater than 10,000, the low-temperature fixability thereof deteriorates. The unmodified polyester resin (ii) preferably has a hydroxyl value not less than 5 mg KOH/g, more preferably of from 10 to 120 mg KOH/g, and most preferably from 20 to 80 mg KOH/g. When less than 5 mg KOH/g, the resultant toner has a difficulty in having a thermostable preservability and a low-temperature fixability. The unmodified polyester resin (ii) preferably has an acid value of from 1 to 5 mg KOH/g, and more preferably from 2 to 4 mg KOH/g. A wax having a high acid value is used in the present invention, and a binder preferably has a low acid value because the resultant toner has good chargeability and volume resistivity, which is suitable for a two-component developer.

The binder resin of the present invention preferably has a glass transition temperature (Tg) of from 35 to 70° C., and more preferably from 55 to 65° C. When less than 35° C., a thermostable preservability of the resultant toner deteriorates. When greater than 70° C., a low-temperature fixability thereof is insufficient. The toner of the present invention has a better thermostable preservability than known polyester toners even though the glass transition temperature is low because the urea-modified polyester is easy to be present at the surface of the mother particle.

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast. Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The toner particles preferably include the colorant in an amount of from 1 to 15% by weight, and more preferably from 3 to 10% by weight.

The colorant for use in the present invention can be used as a master batch pigment when combined with a resin. Specific examples of the resin for use in the master batch pigment or for use in combination with master batch pigment include the modified and unmodified polyester resins mentioned above; styrene polymers and substituted styrene polymers such as polystyrene, poly-p-chlorostyrene and polyvinyltoluene; or their copolymers with vinyl compounds; polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed can be preferably used because the resultant wet cake of the colorant can be used as it is. Of course, a dry powder which is prepared by drying the wet cake can also be used as a colorant. In this case, a three-roll mill is preferably used for kneading the mixture upon application of high shear stress.

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensationproduct), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Particularly, a charge controlling agent controlling a toner to be negatively charged is preferably used.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

As an inorganic filler for controlling the shape of a toner, montmorillonite or its organic-modified material (Clayton APA) is preferably used. The inorganic filler forms concavities and convexities on the surface of a toner, and the mechanism is as follows. In a method of emulsifying a toner constituent liquid in an aqueous medium under the presence of a surfactant and a particulate resin to prepare a toner, inorganic fillers in the toner constituent liquid move to an interface between an organic solvent and the aqueous medium and gather on the surface of an emulsified dispersion (reaction product). Next, in a process of removing the organic solvent from the emulsified dispersion (reaction product), and washing and drying the reaction product, the inorganic filler forms concavities and convexities on the surface of the reaction product. The inorganic filler is included in a toner in an amount of from 0.1 to 10 parts by weight per 100 parts by weight of a resin to form the shape of the toner of the present invention. The more the inorganic filler, the larger the SF-1 and SF-2, i.e., the more deformed a toner. The chargeability of the mother particle is thought to be largely influenced by an amount of a chargeable material on the surface of the mother particle. Particularly, the montmorillonite or its organic-modified material has chargeability, and a mother particle including a large amount of this on the surface has sufficient chargeability. Therefore, layered inorganic minerals such as montmorillonite increasing the chargeability of a mother particle in addition to forming concavities and convexities on the surface are preferably used as the inorganic filler.

Specific examples of the inorganic filler include bentonite, hectolite, attapulgite, sepiolite, their mixtures, etc. besides the montmorillonite and its organic-modified material (Clayton APA). Particularly, the organic-modified montmorillonite and bentonite are preferably used because of being capable forming of concavities and convexities on the surface of a toner and charging a toner with a small amount thereof. A layered inorganic mineral which is at least partially modified with an organic ion such as montmorillonite is used in toner constituents dispersed in an aqueous medium to granulate a deformed toner with ease. The layered inorganic mineral has high hydrophilicity due to its layered structure. The layered inorganic mineral which is at least partially modified with an organic anion has appropriate hydrophobicity, and can deform a toner.

An inorganic particulate material can be used as an external additive to assist the fluidity, developability and chargeability of a toner. The inorganic particulate material preferably has a primary particle diameter of from $5\times10^{-3}$ to 0.3 μm. In addition, the inorganic particulate material preferably has a specific surface area of from 100 to 500 $m^2/g$ when measured by BET method. A toner preferably includes the inorganic particulate material in an amount of from 0.01 to 5% by weight, and more preferably from 0.01 to 2.0% by weight.

Specific examples of the inorganic particulate material include silica, titanium oxide, alumina, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Besides, polymeric particulate materials such as polystyrene formed by a soap-free emulsion polymerization, a suspension polymerization or a dispersion polymerization; ester methacrylate or ester acrylate copolymer; silicone; benzoguanamine; polycondensated products such as nylon; polymeric particulate materials formed of thermosetting resins; etc. can be used.

The external additive can be subjected to surface treatment to increase the hydrophobicity to prevent deterioration of fluidity and chargeability of the resultant toner even in an environment of high humidity. Specific examples thereof include a silane coupling agent, a sililating agent, a silane coupling agent having an alkyl fluoride group, an organic titanate coupling agent, an aluminium coupling agent a silicone oil and a modified silicone oil.

Particularly, hydrophobic silica and hydrophobic titanium oxide subjected to the surface treatment are preferably used.

Next, a preferred method of preparing the toner of the present invention will be explained, but methods thereof are not limited thereto.

(Preparation of Toner Binder)

A toner binder of the present invention can be prepared, for example, by the following method. The polyol (PO) and polycarboxylic acid (PC) are heated at a temperature of from 150 to 280° C. in the presence of a known catalyst such as tetrabutoxy titanate and dibutyltinoxide. Then, water generated is removed, under a reduced pressure if desired, to prepare a polyester resin having a hydroxyl group. Then the polyester resin is reacted with the polyisocyanate (PIC) at a temperature of from 40 to 140° C. to prepare a prepolymer (A) having an isocyanate group. Further, the prepolymer (A) is reacted with an amine (B) at a temperature of from 0 to 140° C. to prepare a urea-modified polyester.

When (PIC), and (A) and (B) are reacted, a solvent can be used if desired. Suitable solvents include solvents which do not react with (PIC). Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetoaminde; ethers such as tetrahydrofuran.

When the unmodified polyester (ii) is used in combination with the modified polyester (i), a method similar to a method for preparing a polyester resin having a hydroxyl group is used to prepare the unmodified polyester (ii), and which dissolved and mixed in a solution after a reaction of the modified polyester (i) is completed.

The urea-modified polyester may be mixed as a binder resin, however, it is preferable, in a method of dispersing toner constituents in an organic solvent and granulating a toner in an aqueous medium, that the toner constituents including comparatively a low-molecular-weight prepolymer having a terminal isocyanate group is subjected to a chain elongation and/or a crosslinking reaction with amines while or after granulating a toner having a urea-modified polyester.

When the unmodified polyester (ii) is used in combination the urea-modified polyester, toner constituents including the prepolymer having a terminal isocyanate group and the unmodified polyester are dispersed in an organic solvent, and subjected to a chain elongation and/or a crosslinking reaction to granulate a toner.

(Preparation of Toner)

1) A colorant, a polyester resin, a polyester prepolymer having an isocyanate group (A), a release agent, etc. are dispersed in an organic solvent to prepare a toner constituent liquid. Preferably, at least a polyester prepolymer having an isocyanate group (A), an unmodified polyester (ii), a colorant, paraffin wax and an inorganic filler are dispersed in an organic solvent to prepare a toner constituent liquid. The organic solvent is preferably volatile and has a boiling point lower than 100° C. because of being easily removed from the dispersion after the mother particle is formed. Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. The addition quantity of such a solvent is from 0 to 300 parts by weight, preferably from 0 to 100, and more preferably from 25 to 70 parts by weight, per 100 parts by weight of the prepolymer (A) used.

2) The toner constituent liquid is emulsified in an aqueous medium under the presence of surfactant and a particulate resin.

The aqueous medium for use in the present invention includes water alone and mixtures of water with a solvent which can be mixed with water. Specific examples of such a solvent include alcohols such as methanol, isopropanol and ethylene glycol; dimethylformamide; tetrahydrofuran; cellosolves such as methyl cellosolve; and lower ketones such as acetone and methyl ethyl ketone.

The content of the aqueous medium to 100 parts by weight of the toner constituent liquid is typically from 50 to 2,000 parts by weight, and preferably from 100 to 1,000 parts by weight. When the content is less than 50 parts by weight, the dispersion of the toner constituents in the aqueous medium is not satisfactory, and thereby the resultant mother toner particles do not have a desired particle diameter. In contrast, when the content is greater than 2,000, the production cost increases.

The particulate resin dispersed in the aqueous medium preferably has a glass transition temperature (Tg) of from 50 to 110° C., more preferably from 50 to 90° C., and furthermore preferably from 50 to 70° C. When less than 50° C., storageability of the resultant toner deteriorates, and the toner is possibly fixed or agglutinated in a recycle route. When higher than 110° C., the particulate resin impairs the adhesiveness of the resultant toner to a transfer paper and the fixable minimum temperature thereof increases.

The particulate resin preferably has a weight-average molecular weight of from 4,000 to 150,000, and more preferably from 4,000 to 50,000. When greater than 100,000, the particulate resin impairs the adhesiveness of the resultant toner to a transfer paper and the fixable minimum temperature thereof increases.

Specific examples of the particulate resin include any thermoplastic and thermosetting resins capable of forming a dispersion element such as vinyl resins, polyurethane resins, epoxy resins and polyester resins. These resins can be used alone or in combination. Among these resins, the vinyl resins, the polyurethane resin, the epoxy resin, the polyester resin and their combinations are preferably used in terms of forming an aqueous dispersion of microscopic spherical particulate resins.

Specific examples of the vinyl resins include homopolymerized or copolymerized polymers such as styrene-(metha) esteracrylate resins, styrene-butadiene copolymers, (metha) acrylic acid-esteracrylate polymers, styrene-acrylonitrile copolymers, styrene-maleic acid anhydride copolymers and styrene-(metha)acrylic acid copolymers.

The particulate resin preferably has a volume-average particle diameter of from 10 to 200 nm, and more preferably from 20 to 80 nm when measured by a light scattering photometer from Otsuka Electronics Co., Ltd.

Dispersants such as surfactants and particulate resins are optionally added to the aqueous medium to improve the dispersion therein.

Specific examples of the dispersants used to emulsify and disperse an oil phase for a liquid including water in which the toner constituents are dispersed include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle) glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium-{omega-fluoroalkanoyl(C6-C8)-N-ethylamino}-1-propane sulfonate, fluoroalkyl(C11-C20) carboxylic acids and their metal salts, perfluoroalkylcarboxylic acids and their metal salts, perfluoroalkyl (C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonyl glycin, monoperfluoroalkyl(C6-C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as erfluoroalkyl (C6-C10) sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

The particulate resin is added to the aqueous medium to stabilize a mother particle formed therein or prevent a wax from exposing to the uppermost surface of the resultant toner. Therefore, the particulate resin is preferably added thereto so as to cover the surface of the mother particle at a coverage of from 10 to 90%. Specific examples thereof include particulate polymethylmethacrylate having a particle diameter of 1 μm and 3 μm, particulate polystyrene having a particle diameter of 0.5 μm and 2 μm, particulate styrene-acrylonitrile copolymers having a particle diameter of 1 μm, PB-200H (from Kao Corp.), SGP (Soken Chemical & Engineering Co., Ltd.), TECHNOPOLYMER SB (Sekisui Plastics Co., Ltd.), SPG-3G (Soken Chemical & Engineering Co., Ltd.), and MICROPEARL (Sekisui Fine Chemical Co., Ltd.).

In addition, inorganic compound dispersants such as tricalcium phosphate, calcium carbonate, titanium oxide, colloidal silica and hydroxyapatite which are hardly insoluble in water can also be used.

Further, it is possible to stably disperse toner constituents in water using a polymeric protection colloid in combination with the particulate resin and/or the inorganic compound dispersants mentioned above. Specific examples of the protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid). When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C.

3) While an emulsion is prepared, amines (B) are included therein to be reacted with the polyester prepolymer (A) having an isocyanate group.

This reaction is accompanied by a crosslinking and/or a elongation of a molecular chain. The reaction time depends on reactivity of an isocyanate structure of the prepolymer (A) and amines (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

4) After the reaction is terminated, an organic solvent is removed from an emulsified dispersion (a reactant), which is washed and dried to form a parent toner particle.

The prepared emulsified dispersion (reactant) is gradually heated while stirred in a laminar flow, and an organic solvent is removed from the dispersion after stirred strongly when the dispersion has a specific temperature to form a parent toner particle having the shape of a spindle. When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

5) A charge controlling agent is beat in the parent toner particle, and inorganic particulate materials such as particulate silica and particulate titanium oxide are externally added thereto to form a toner.

Known methods using a mixer, etc. are used to beat in the charge controlling agent and to externally add the inorganic particulate materials.

Thus, a toner having a small particle diameter and a sharp particle diameter distribution can be obtained. Further, the strong agitation in the process of removing the organic solvent can control the shape of a toner from a sphere to a rugby ball, and the surface morphology thereof from being smooth to a pickled plum.

The toner of the present invention can be used as both of a one-component developer and a two-component developer with a carrier.

The carriers include conventional ferrite carriers and magnetite carriers, and resin-coated carriers.

The carrier of the present invention is preferably an almost spherical core material coated with a resin wherein a particulate material is dispersed, which has an average particle diameter of from 20 to 45 μm and the following formula:

$$(MgO)x(MnO)y(Fe_2O_3)z$$

wherein x is from 1 to 5, y is from 5 to 55 and z is from 45 to 55. The carrier may include other constituents such as impurities and constituents due to substitution and addition, as long as the above-mentioned formula is satisfied. Specific examples of the other constituents include, but are not limited to, $SnO_2$, SrO, alkaline earth metal oxides, $Bi_2O_5$ and ZrO.

The carrier has two functions. One is to feed the toner to a developing area and the other is to charge the toner in an image developer wherein the carrier and toner are stirred.

Particularly, the carrier has good fluidity in the image developer and is capable of uniformly feeding the toner, i.e., a latent image is uniformly developed. Further, the uniform developed toner layer can uniformly be transferred as well.

In addition, a latent image can uniformly be developed with a developer including the carrier and a toner even when the properties of the toner slightly vary.

Specific examples of the resin coating the surface of the carrier include, but is not limited to, an acrylic resin and/or a silicone resin. These resins make the above-mentioned core material strongly exert an effect of uniformly feeding and charging the toner. The acrylic resin has high adhesiveness and low brittleness, and therefore has very good abrasion resistance. However, since the acrylic resin has a high surface energy, charge quantity thereof lowers when combined with a toner tending to be spent (fusion bonded on the surface of the carrier). However, when combined with the silicone resin having low surface energy and the spent toner is difficult to accumulate thereon, this problem can be solved. However, the silicone resin has low adhesiveness and high brittleness, and therefore has poor abrasion resistance. Therefore, it is important to use the two resins in a balanced manner, and which enables the carrier to be coated with a film the spent toner is difficult to occur on, and having abrasion resistance. The acrylic resin is preferably included in an amount of fro 10 to 90% by weight based on total weight of the resin coating the surface of the carrier. When less than 10% by weight, the silicone resin mostly coats the carrier, resulting in poor abrasion resistance because of the high brittleness of the silicone resin. When greater than 90% by weight, the acrylic resin mostly coats the carrier, resulting in accumulation of the spent toner because of high surface energy of the acrylic resin.

The acrylic resin in the present invention represents all resins including an acrylic constituent, and is not particularly limited. The acrylic resin can be used alone, and a combination with at least one other constituent crosslinking therewith can also be used. Specific examples of the other constituent crosslinking therewith include, but is not limited to, an amino resin and an acidic catalyst. Specific examples of the amino resin include, but is not limited to, a guanamine resin and a melamine resin. Specific examples of the acidic catalyst include, but is not limited to, any materials having a catalytic influence. Specific examples thereof include, but is not limited to, materials having a reactive group such as a complete alkyl group, a methylol group, an imino group and a methylol/imino group.

Specific examples of the silicone resin include, but is not limited to, any known silicone resins such as straight silicones and silicones modified with a resin such as an alkyd resin, a polyester resin, an epoxy resin, an acrylic resin and a urethane resin. Specific examples of marketed products of the straight silicones include, but are not limited to, KR271, KR255 and KR152 from Shin-Etsu Chemical Co., Ltd; and SR2400, SR2406 and SR2410 from Dow Corning Toray Silicone Co., Ltd. The straight silicone resins can be used alone, and a combination with other constituents crosslinking therewith or charge controlling constituents can also be used. Specific examples of the modified silicones include, but are not limited to, KR206 (alkyd-modified), KR5208 (acrylic-modified), EX1001N (epoxy-modified) and KR305 (urethane-modified) from Shin-Etsu Chemical Co., Ltd; and SR2115 (epoxy-modified) and SR2110 (alkyd-modified) from Dow Corning Toray Silicone Co., Ltd.

As mentioned above, a combination of the acrylic resin and silicone resin satisfies spent toner resistance, abrasion resistance and adhesiveness required for the coated film of the carrier. Specifically, the acrylic resin is used for an adhesive layer to strengthen the adhesiveness thereof to the core material, and the silicone resin is used as the coated film, but are not limited thereto.

A particulate alumina or a particulate surface-treated alumina is preferably dispersed in the resin-coated layer of the carrier such that the toner can negatively be charged.

The particulate alumina or particulate surface-treated alumina is dispersed in the resin-coated layer of the carrier such that the coated layer is protected from an external force applied to the surface of the carrier. The particulate alumina or particulate surface-treated alumina can protect the coated layer from the external force for long periods. The particulate alumina or particulate surface-treated alumina preferably has a particle diameter not greater than 5 μm, and is preferably dispersed in the acrylic resin having strong adhesiveness to hold the particulate alumina or particulate surface-treated alumina for long periods, but is not necessarily dispersed therein.

Further, the resin-coated layer effectively includes carbon black. The carbon black decreased high resistivity of the resin-coated layer or resin-coated layer including the particulate alumina or particulate surface-treated alumina. Typically when a carrier having high resistivity is used in a developer, the resultant copy image having a large area has high edge effect (the center of the image has very low density and only the edge has high density). Letters and thin lines are clearly produced because of the edge effect, but a halftone image is very poorly produced. Therefore, when the carbon black is properly used, quality images can be produced, and further the carbon black can be used for a carrier for a color developer.

When the coated film of the carrier for a color developer, including carbon black, is peeled off therefrom and mixed in an image, the image is a defective image because the coated film is clearly noticeable therein. However, in the present invention, since the coated film includes an acrylic resin having high adhesiveness and being difficult to wear, the coated film strongly holds the carbon black and the carbon black scarcely leave from the carrier. Particularly, the carbon black dispersed in the acrylic resin can avoid defective images, i.e., the carrier formed of a core material, an acrylic resin layer wherein the carbon black is dispersed on the core material, and a silicone resin layer not including the carbon black on the acrylic resin layer can more effectively avoid defective images. In the present invention, any carbon black typically used for a carrier and a toner can be used. On the other hand, the carbon black cannot be used in the silicone resin having high brittleness and being easy to wear because a peeled black film appears in an image.

The carrier is prepared by a method of fully dispersing the resin and the particulate material to prepare a resin-coated film forming liquid, coating the liquid on the surface of the carrier and drying the liquid.

The toner and the developer of the present invention can be used in a process cartridge detachable from an image forming apparatus, which has a photoreceptor and at least one of a charger, an image developer and a cleaner.

FIG. 1 is a schematic vertical cross-sectional view illustrating an embodiment of the process cartridge of the present invention.

The process cartridge in FIG. 1 has a photoreceptor, a charger, an image developer and a cleaner. In the present invention, a plurality of the photoreceptor, the charger, the image developer and the cleaner are combined in a body as a process cartridge, and the process cartridge is detachable from an image forming apparatus such as copiers and printers. The image developer includes the toner or the developer of the present invention.

Figure 2:
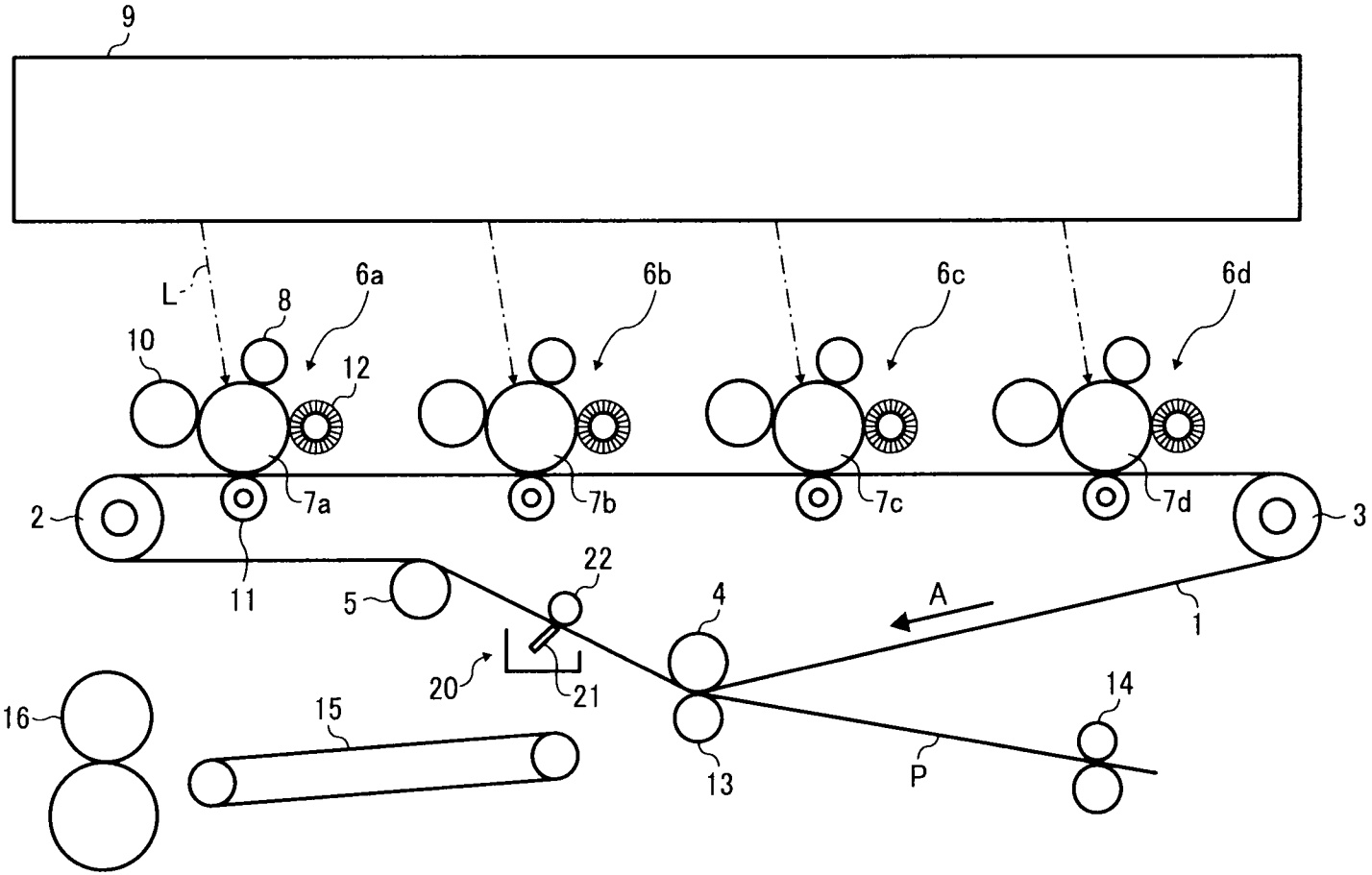
FIG. 2 is a schematic view illustrating an embodiment of the image forming apparatus of the present invention.

FIG. 2 is a schematic view illustrating an embodiment of the image forming apparatus of the present invention.

In FIG. 2, an intermediate transfer belt (1) as an image bearer is rolled over rollers (2), (3), (4) and (5), and is driven in the direction of an arrow A when the roller (2) or (3) rotates clockwise as a drive roller. First to fourth image forming units (6*a*), (6*b*), (6*c*) and (6*d*) are formed facing an upper traveling side. The first to fourth image forming units (6*a*), (6*b*), (6*c*) and (6*d*) have drum-shaped photoreceptors (7*a*), (7*b*), (7*c*) and (7*d*) as image bearers, and form a magenta toner image, a cyan toner image, a yellow toner image and a black toner image thereon, respectively.

The first to fourth image forming units (6*a*), (6*b*), (6*c*) and (6*d*) all form toner images on their image bearers in substantially the same methods, and only a mechanism of forming a toner image on the photoreceptor (7*a*) by the image forming unit (6*a*) will be explained using FIG. 3.

A photoreceptor (7) is driven to rotate anticlockwise and the surface thereof is evenly charged by a charging roller (8) to have a predetermined polarity. Next, a photo-modulated laser beam (L) emitted from a laser writing unit (9) in FIG. 2 is irradiated on the charged surface. This forms an electrostatic latent image on the photoreceptor (7), and the electrostatic latent image is visualized, e.g., as a magenta toner image by an image developer (10).

A voltage having a reverse polarity to that of the toner is applied to a transfer roller (11) sandwiching the intermediate transfer belt (1) with the photoreceptor (7) to transfer the magenta toner image on the photoreceptor (7) onto the intermediate transfer belt (1).

The toner untransferred onto the intermediate transfer belt (1) remaining on the photoreceptor (7) is removed by a cleaner (12).

In the same method, a cyan toner image, a yellow toner image and a black toner image are formed on the photoreceptors (7*b*), (7*c*) and (7*d*) of the second to fourth image forming units (6*b*), (6*c*) and (6*d*), respectively. These toner images are sequentially overlapped on the magenta toner image on the intermediate transfer belt (1). The resultant overlapped four-color toner image formed on the intermediate transfer belt (1) is transported to a second transfer roller (13) at the right end of FIG. 2.

Below the apparatus, a paper feeder (not shown) is formed and a recording material (P), e.g., a transfer paper is fed therefrom. After the recording material (P) is struck against a registration roller (14) in FIG. 2, the recording material (P) is transported to a second transfer site of the intermediate transfer belt (1) such that the toner image is correctly transferred onto the recording material (P). A voltage having a reverse polarity to the toner on the intermediate transfer belt (1) is applied to the second transfer roller (13) to transfer the overlapped toner images on the intermediate transfer belt (1) onto the recording material (P). The recording material (P) the toner image is transferred onto is conveyed to a fixer (16) through a conveyor belt (15), where the toner image is fixed on the recoding material (P) and, and is discharged to a paper ejection site (not shown), etc.

The toner untransferred onto the recoding material (P) remaining on the intermediate transfer belt (1) after the second transfer is removed by a belt cleaner (20) having a cleaning blade (21) scraping the intermediate transfer belt (1). A backup roller (22) is formed to firmly contact the blade (21) to the intermediate transfer belt (1).

The above-mentioned image forming apparatus using the intermediate transfer method occasionally produces images on which toner images locally fall out (hereinafter referred to as a vermiculation). The present inventors discovered that the vermiculation is difficult to occur when the photoreceptor (7) has a surface friction coefficient lower than that of the intermediate transfer belt (1).

Pattern are occasionally formed between images to control toner adherence amount and adjust positioning. Being not transferred onto papers, these patterns contact the second transfer roller (13) and all or a part of them is transferred onto the surface of the roll. Therefore, a cleaner is needed to remove the patterns from the roller. A cleaning blade is typically used as the cleaner, but the blade occasionally turns inward to prevent or stop the rotation of the roller.

The apparatus used to extrapolate Examples and Comparative Examples of the present invention includes lubricant applicators applying a lubricant to the photoreceptor (7), the intermediate transfer belt (1) and the second transfer roller (13).

The intermediate transfer belt (1) is an endless belt formed of an iron core covered with a polyimide film. The polyimide film is produced by dispersing carbon black in a polyamic acid solution to prepare a dispersion, placing the dispersion in a metallic drum and drying the dispersion to form a film, separating the film from the metallic drum, expanding the film at a high temperature and cutting the film to have a suitable size. The film is formed by injecting a polymer solution in which carbon black is dispersed into a cylindrical metallic mold, and rotating the metallic mold to centrifugally form a film while heating the solution at 100 to 200° C. The film is demolded while partially hardened and an iron core is covered therewith. The polyimidization is accelerated at 300 to 450° C. and the film is hardened to prepare the intermediate transfer belt (1). The surface resistivity thereof can be controlled changing an amount of the carbon, calcination temperature, hardening speed, etc. The belt had a surface friction coefficient of 0.45 when measured by HEIDON TRIBOGEAR μs 94i from SHINTO Scientific Co., Ltd.

An embodiment of the lubricant applicator will be explained using FIG. 3. A lubricant applicator (30) in FIG. 3 applies a lubricant to the photoreceptor (7), and can be used as a lubricant applicator for the intermediate transfer belt (1) and the second transfer roller (13).

Figure 3:
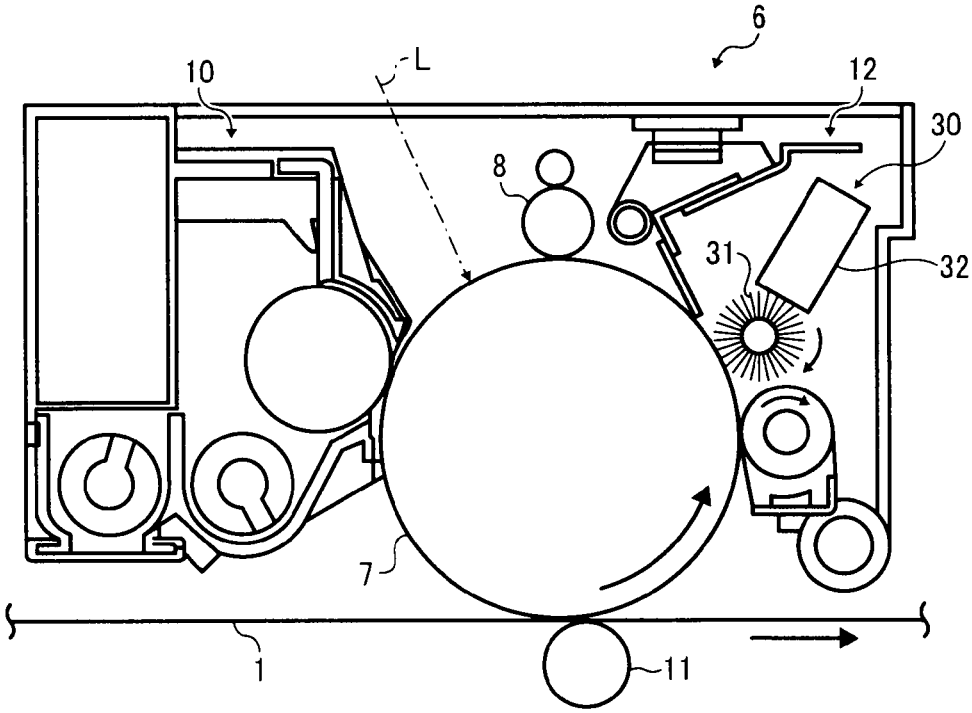
FIG. 3 is a schematic vertical cross-sectional view illustrating an embodiment of the image forming unit of the present invention.
Figure 4:
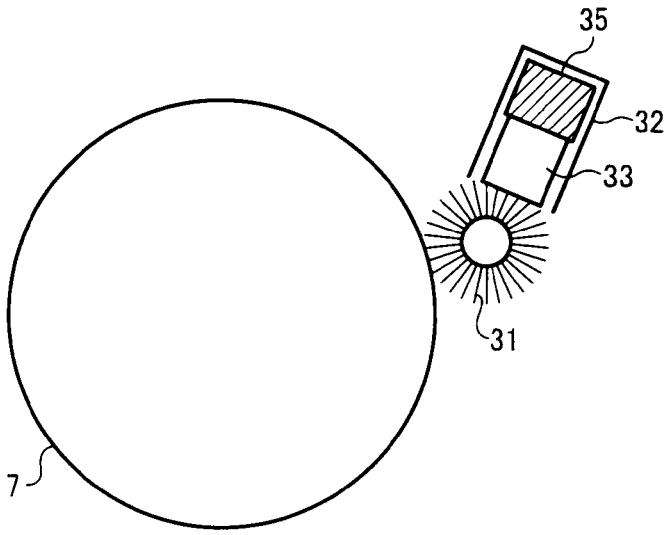
FIG. 4 is a schematic view illustrating an embodiment of lubricators.
Figure 5:
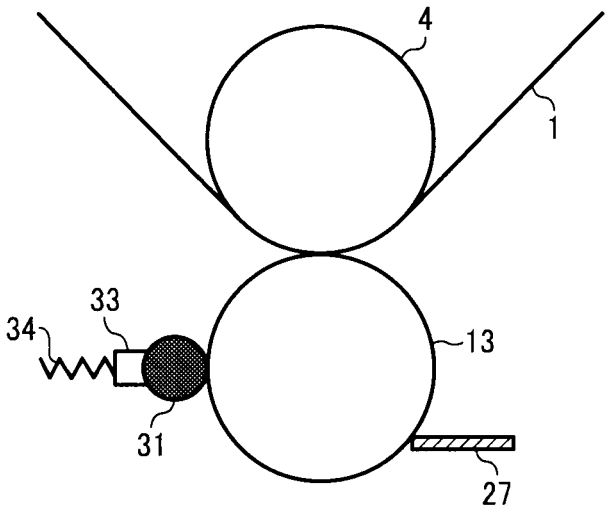
FIG. 5 is a schematic view illustrating another embodiment of lubricators.
Figure 6:
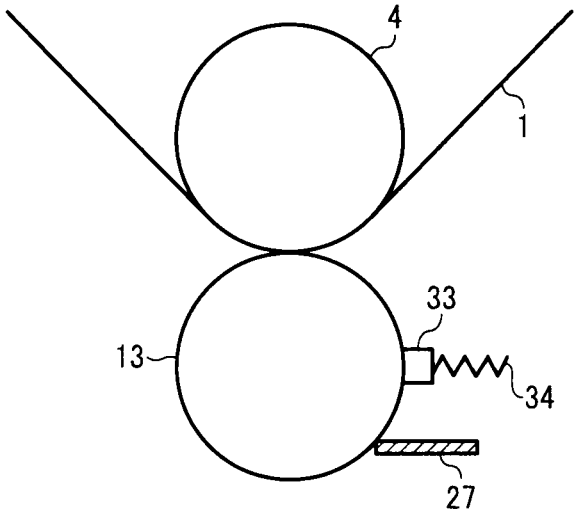
FIG. 6 is a schematic view illustrating a further embodiment of lubricators.

In FIG. 3, the lubricant applicator (30) is located in the cleaner (12), and includes an application brush (31) and a lubricant unit (32). The lubricant unit (32) is formed of a solid lubricant (33) and a spring (34) as a pressurizer pressing the lubricant to the application brush (31) as shown in FIG. 5. The pressure of the spring (34) is changed to change an application amount of the lubricant (33). A weight (35) can be used as the pressurizer instead of the spring (34) as shown in FIG. 4. The weight of the weight (35) is changed to change an application amount of the lubricant (33). Further, as shown in FIG. 6, the lubricant may be directly applied without using the application brush (31).

The lubricant applicator (30) is arranged for each of the photoreceptor (7), the intermediate transfer belt (1) and the second transfer roller (13) to properly fix each surface friction coefficient thereof and make the surface friction coefficient of the intermediate transfer belt (1) larger than those of the photoreceptor (7) and the second transfer roller (13).

The lubricant applicator (30) is arranged for each of the photoreceptor (7), the intermediate transfer belt (1) and the second transfer roller (13). However, the lubricant applicator (30) may not be arranged for the intermediate transfer belt (1), and a lubricant applied to the photoreceptor (7) and the second transfer roller (13) may be indirectly applied to the intermediate transfer belt (1). The lubricant is indirectly applied to the intermediate transfer belt (1) and applied thereto less than to the photoreceptor (7) and the second transfer roller (13). Therefore, the surface friction coefficient of the intermediate transfer belt (1) can easily be larger than those of the photoreceptor (7) and the second transfer roller (13).

Further, a surface layer may be formed on the photoreceptor (7) for the purpose of making the surface friction coefficient of the intermediate transfer belt (1) larger than those of the photoreceptor (7) and the second transfer roller (13).

Specific examples of materials for use in the surface layer of the photoreceptor (7) include resins such as styrene-acrylonitrile copolymers, styrene-butadiene copolymers, acrylonitrile-butadiene-styrene copolymers, olefin-vinyl monomer copolymers, chlorinated polyether, aryl resins, phenol resins, polyacetal resins, polyamide resins, polyamideimide resins, polyacrylate resins, polyallylsulfone resins, polybutylene resins, polybutyleneterephthalate resins, polycarbonate resins, polyethersulfone resins, polyethylene resins, polyethyleneterephthalate resins, polyimide resins, acrylic resins, polymethylpentene resins, polypropylene resins, polyphenyleneoxide resins, polysulfone resins, polyurethane resins, polyvinylchloride, polyvinylidenechloride and epoxy resins.

For the purpose of reducing the friction coefficient of the resin, lubricants such as a particulate fluorine-containing resin, polyolefin resin and silicone resin are added thereto.

Specific examples of the particulate fluorine-containing resin include polymers and copolymers of tetrafluoroethylene, hexafluoropropylene, trifluoromethylene, chlorotrifluoroethylene, fluorinated vinylidene, fluorinated vinyl, perfluoroalkylvinylether, etc.

Specific examples of the particulate polyolefin resin include olefin homopolymers such as ethylene, propylene and butene; copolymers with dissimilar olefins or their heat-modified particulate materials such as polyethylene, polypropylene, polybutene, polyhexene, ethylene-propylene copolymers, ethylene-butene-copolymers and ethylene-propylene-hexene copolymers.

Specific examples of the particulate silicone resin include silicone resins insoluble in an organic solvent, having a network structure formed of a three-dimensional siloxane bonding, in which silicon atoms are substituted with an alkyl group, an aryl group, an amino-substituted alkyl group, dialkylsilicone, etc.

The photoreceptor (7) including such a surface layer typically has a surface friction coefficient of from 0.1 to 0.3.

The intermediate transfer belt (1) typically has a surface friction coefficient of from 0.35 to 0.7 although varying due to the surface roughness.

The photoreceptor and the intermediate transfer belt prevent the vermiculation and improves the transferability of a toner because the photoreceptor has a surface friction coefficient lower than that of the intermediate transfer belt.

Further, the lubricant applicator (30) for the second transfer roller (13) prevents a cleaning blade (27) from turning inward.

As long as photoreceptor (7) has a surface friction coefficient lower than that of the intermediate transfer belt (1), the vermiculation is within an acceptable range. The surface friction coefficients of the photoreceptor (7) and the intermediate transfer belt (1) were controlled by controlling amounts of the lubricant applied thereto. The amounts of the lubricant were controlled by controlling a pressure of the lubricant thereto. Besides, a contact time or a contact area of the lubricant thereto may be controlled to control the amounts of the lubricant.

The lower the surface friction coefficients of the photoreceptor (7) than that of the intermediate transfer belt (1), the higher the transferability of a toner. Therefore, the vermiculation can be prevented and a toner has good transferability when the photoreceptor (7) has a surface friction coefficient lower than that of the intermediate transfer belt (1), which can be achieved by lessening an amount of the lubricant applied to the intermediate transfer belt (1) than that to the photoreceptor (7).

A blade contacting the second transfer roller (13) is more likely to turn inward than the same blade contacting the intermediate transfer belt (1). The higher the surface friction coefficient of the roller or belt, the more the blade turns inward. The blade contacting the second transfer roller (13) turns inward sooner than the same blade contacting the intermediate transfer belt (1). Therefore, at least the surface friction coefficient of the roller needs to be lower than that of the belt to prevent the blade for the roller from turning inward. Then, when the intermediate transfer belt has such a friction coefficient as to prevent the blade therefor from turning inward, turning inward of the blade for the roller can very effectively be prevented.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium can be mixed in a reactor vessel including a stirrer and a thermometer, and the mixture stirred for 30 min at 3,800 rpm to prepare a white emulsion therein. The white emulsion can be heated to have a temperature of 75° C. and reacted for 4 hrs. Further, 30 parts of an aqueous solution of persulfate ammonium having a concentration of 1% can be added thereto and the mixture was reacted at 75° C. for 6 hrs to prepare an aqueous dispersion a

[particulate dispersion liquid 1] of a vinyl resin (a copolymer of a sodium salt of an adduct of styrene-methacrylate-butylacrylate-sulfuric ester with ethyleneoxide methacrylate). The [particulate dispersion liquid 1] can be measured by LA-920 to find a volume-average particle diameter thereof was 110 nm. Apart of the [particulate dispersion liquid 1] can be dried to isolate a resin component therefrom. The resin component should have a Tg of 58° C. and a weight-average molecular weight of 130,000.

990 parts of water, 83 parts of the [particulate dispersion liquid 1], 37 parts of an aqueous solution of sodium dodecyldiphenyletherdisulfonate having a concentration of 48.3% (ELEMINOL MON-7 from Sanyo Chemical Industries, Ltd.) and 90 parts of ethyl acetate can be mixed and stirred to prepare a lacteous liquid an [aqueous phase 1].

724 parts of an adduct of bisphenol A with 2 moles of ethyleneoxide and 276 parts terephthalic acid can be polycondensated in a reactor vessel including a cooling pipe, a stirrer and a nitrogen inlet pipe at a normal pressure and 230° C. for 5 hrs. Further, after the mixture is depressurized by 10 to 15 mm Hg and reacted for 5 a [low-molecular-weight polyester 1] can be prepared. The [low-molecular-weight polyester 1] should have a number-average molecular weight of 2,300, a weight-average molecular weight of 6,700, a Tg of 43° C. and an acid value of 4.

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide can be mixed and reacted in a reactor vessel including a cooling pipe, a stirrer and a nitrogen inlet pipe at a normal pressure and 230° C. for 7 hrs. Further, after the mixture is depressurized to 10 to 15 mm Hg and reacted for 5 hrs to prepare an [intermediate polyester 1]. The [intermediate polyester 1] should have a number-average molecular weight of 2,200, a weight-average molecular weight of 9,700, a Tg of 54° C. and an acid value of 0.5 and a hydroxyl value of 52.

Next, 410 parts of the [intermediate polyester 1], 89 parts of isophoronediisocyanate and 500 parts of ethyl acetate can be reacted in a reactor vessel including a cooling pipe, a stirrer and a nitrogen inlet pipe for 5 hrs at 100° C. to prepare a [prepolymer 1]. The [prepolymer 1] should include a free isocyanate in an amount of 1.53% by weight.

170 parts of isophoronediamine and 75 parts of methyl ethyl ketone can be reacted at 50° C. for 4 hrs and a half in a reaction vessel including a stirrer and a thermometer to prepare a [ketimine compound 1]. The [ketimine compound 1] should have an amine value of 417.

1,200 parts of water, 540 parts of carbon black (Printex 35 from Degussa A.G. having a DBP oil absorption of 42 ml/100 mg and a pH of 9.5) and 1,200 parts of a polyester resin can be mixed by a HENSCHEL MIXER from Mitsui Mining Co., Ltd. After the mixture is kneaded by a two-roll mill having a surface temperature of 130° C. for 1 hr min, the mixture can be extended by applying pressure, cooled and pulverized by a pulverizer to prepare a [master batch 1].

378 parts of the [low-molecular-weight polyester 1], 100 parts of paraffin wax having a melting point of 70° C. and 947 parts of ethyl acetate can be mixed in a reaction vessel including a stirrer and a thermometer. The mixture can be heated to have a temperature of 80° C. while stirred. After the temperature of 80° C. is maintained for 5 hrs, the mixture can be cooled to have a temperature of 30° C. in an hour. Then, 500 parts of the [master batch 1], 30 parts of an organic-modified montmorillonite Clayton APA from Southern Clay Products, Inc. and 500 parts of ethyl acetate can be added to the mixture and mixed for 1 hr to prepare a [material solution 1].

1,324 parts of the [material solution 1] can be transferred into another vessel, and the carbon black and wax therein can be dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 1] having a concentration of 65% can be added to the [material solution 1] and the mixture can be stirred by the beads mill for 2 passes under the same conditions to prepare a [pigment and wax dispersion liquid 1]. The [pigment and wax dispersion liquid 1] should have a solid content concentration of 50%.

749 parts of the [pigment and wax dispersion liquid 1], 115 parts of the [prepolymer 1] and 2.9 parts of the [ketimine compound 1] can be mixed in a vessel by a TK-type homomixer from Tokushu Kika Kogyo Co., Ltd. at 5,000 rpm for 2 min. 1,200 parts of the [aqueous phase 1] can be added to the mixture and mixed by the TK-type homomixer at 13,000 rpm for 25 min to prepare an [emulsified slurry 1].

The [emulsified slurry 1] can be put in a vessel including a stirrer and a thermometer. After a solvent is removed from the emulsified slurry 1 at 30° C. for 7 hrs, the slurry can be aged at 45° C. for 7 hrs to prepare a [dispersion slurry 1].

After the [dispersion slurry 1] was filtered under reduced pressure, 100 parts of ion-exchange water can be added to the filtered cake and mixed by the TK-type homomixer at 12,000 rpm for 10 min, and the mixture can be filtered.

Further, 100 parts of an aqueous solution of 10% sodium hydrate can be added to the filtered cake and mixed by the TK-type homomixer at 12,000 rpm for 10 min, and the mixture can be filtered under reduced pressure.

Further, 100 parts of 10% hydrochloric acid can be added to the filtered cake and mixed by the TK-type homomixer at 12,000 rpm for 10 min, and the mixture can be filtered.

Further, 300 parts of ion-exchange water can be added to the filtered cake and mixed by the TK-type homomixer at 12,000 rpm for 10 min, and the mixture can be filtered. This operation can be repeated again to prepare a [filtered cake 1].

The [filtered cake 1] can be dried by an air drier at 45° C. for 48 hrs and sieved by a mesh having an opening of 75 μm to prepare a [toner mother particle 1]. The, 100 parts of the [toner mother particle 1], 1 part of hydrophobic silica 1 and 1 part of hydrophobized titanium oxide can be mixed by a HENSCHEL MIXER to prepare a toner.

Comparative Example 1

The procedure for preparation of the toner in Example 1 can be repeated except for excluding 30 parts of an organic-modified montmorillonite from the [material solution 1].

Comparative Example 2

The procedure for preparation of the toner in Example 1 can be repeated except for replacing 100 parts of the paraffin wax having a melting point 70° C. with 100 parts of a carnauba wax having a melting point 70° C.

Comparative Example 3

The procedure for preparation of the toner in Example 1 can be repeated except for excluding 30 parts of an organic-modified montmorillonite from the [material solution 1] and replacing 100 parts of the paraffin wax having a melting point 70° C. with 100 parts of a paraffin wax having a melting point 110° C.

Comparative Example 4

The procedure for preparation of the toner in Example 1 can be repeated except for excluding 30 parts of an organic-modified montmorillonite from the [material solution 1] and replacing 100 parts of the paraffin wax having a melting point 70° C. with 100 parts of a carnauba wax having a melting point 70° C.

Example 2

The procedure for preparation of the toner in Example 1 can be repeated except for changing 30 parts of an organic-modified montmorillonite to 48 parts thereof in the [material solution 1].

Example 3

The procedure for preparation of the toner in Example 1 can be repeated except for changing 30 parts of an organic-modified montmorillonite to 12 parts thereof in the [material solution 1].

Comparative Example 5

The procedure for preparation of the toner in Example 1 can be repeated except for changing 30 parts of an organic-modified montmorillonite to 60 parts of hydrophobic silica in the [material solution 1].

The predicted aspect ratios (AR), predicted average circularity (AC), predicted weight-average particle diameter (D4), a predicted ratio of the D4 to a number-average particle diameter (D4/Dn), a predicted endothermic peak (EP) of the wax when subjected to a DSC measurement, a predicted glass transition temperature (Tg) and the predicted content (% by number) of particles having a particle diameter not greater than 2 μm of the toner mother particles prepared in the above-mentioned Examples and Comparative Examples are shown in Table 1.

TABLE 1

| | AR | AC | D4 (μm) | D4/Dn | EP (J/g) | Tg (° C.) | % by number |
|---|---|---|---|---|---|---|---|
| Example 1 | 0.85 | 0.960 | 5.8 | 1.2 | 3.8 | 52 | 6 |
| Comparative Example 1 | 0.92 | 0.986 | 5.9 | 1.21 | 4 | 48 | 8 |
| Comparative Example 2 | 0.85 | 0.962 | 5.8 | 1.17 | 4.2 | 50 | 6 |
| Comparative Example 3 | 0.92 | 0.988 | 5.7 | 1.15 | 3.8 | 50 | 7 |
| Comparative Example 4 | 0.92 | 0.987 | 5.8 | 1.19 | 4.1 | 50 | 8 |
| Example 2 | 0.80 | 0.945 | 5.8 | 1.24 | 3.8 | 49 | 8 |
| Example 3 | 0.89 | 0.970 | 5.8 | 1.22 | 3.8 | 49 | 7 |
| Comparative Example 5 | 0.91 | 0.960 | 5.8 | 1.2 | 3.8 | 52 | 7 |

Each of the toners prepared in the above-mentioned Examples and Comparative Examples can be mixed with a carrier prepared by the following method by a TURBULAR MIXER at a maximum stirring strength for 10 min such that a total weight was 1 kg, and a toner concentration of 3% and 12% by weight to prepare a developer.

The following materials can be dispersed by a homomixer for 10 min to prepare a solution for forming a coated film of an acrylic resin and a silicone resin including a particulate alumina.

| | |
|---|---|
| Acrylic resin solution (including a solid content of 50 wt. %) | 21.0 |
| Guanamine solution (including a solid content of 70 wt. %) | 6.4 |
| Particulate alumina (having a particle diameter of 0.3 μm and a resistivity of $10^{14}$ Ω· cm) | 7.6 |
| Silicone resin solution (including a solid content SR2410 of 23% from Dow Corning Toray Silicone Co., Ltd.) | 65.0 |
| Amino silane (including a solid content SH6020 from Dow Corning Toray Silicone Co., Ltd.) | 0.3 |
| Toluene | 60 |
| Butyl cellosolve | 60 |

The solution for forming a coated film can be coated on a calcined ferrite powder $(MgO)_{1.8}(MnO)_{49.5}(Fe_2O_3)_{48.0}$ having an average particle diameter of 35 μm as a core material) by SPIRA COTA from OKADA SEIKO CO., LTD to have a thickness of 0.15 μm, and dried. The dried material can be calcined in an electric oven at 150° C. for 1 hr. The calcined material can be cooled and sieved with a sieve having an opening of 106 μm to prepare a [carrier 1]. The thickness of the resin coated film can be observed with a transmittance electron microscope by observing a cross-sectional surface of the carrier therewith, and an average of the thickness can be determined as the thickness.

After 30,000 and 60,000 images of an image chart having an image area of 50% can be produced in a monochrome mode by a digital full-color copier imagio Color 2800 from Ricoh Company, Ltd. at 25° C. and 50% Rh, a part of the developer can be sampled and the charge quantity thereof can be measured by a blow-off method to evaluate deterioration of the chargeability of the carrier.

The evaluation was based on the predicted difference of the charge quantity before and after producing 30,000 and 60,000 images:

| | |
|---|---|
| less than 5 μc/g: | O |
| 5 to 10 μc/g: | Δ |
| Greater than 10 μc/g: | X. |

A copier MF2200 using a TEFLON (a registered trademark) roller as a fixing roller from Ricoh Company, Ltd., the fixer in which can be modified, can be used to fix an unfixed rectangular (2 cm×7 cm) solid image having a toner adherence amount of 1.0 mg/cm$^2$ on a TYPE 6200 paper from Ricoh Company, Ltd. to evaluate the fixability.

Changing a fixing temperature thereof at a unit of 5° C., a cold offset occurrence temperature and a hot offset occurrence temperature can be determined. The cold offset temperature (COT) can be determined under image forming conditions of a paper feeding linear speed of 120 mm/sec, a surface pressure of 1.2 Kgf/cm$^2$ and a nip width of 3 mm. The hot offset temperature (HOT) can be determined under image forming conditions of a paper feeding linear speed of 50 mm/sec, a surface pressure of 2.0 Kgf/cm$^2$ and a nip width of 4.5 mm.

The predicted results are shown in Table 2.

TABLE 2

| | COT (° C.) | HOT (° C.) | 30,000, 3% | 30,000, 12% | 60,000, 3% | 60,000, 12% |
|---|---|---|---|---|---|---|
| Example 1 | 140 | 200 | ○ | ○ | ○ | ○ |
| Comparative Example 1 | 140 | 200 | Δ | X | X | X |
| Comparative Example 2 | 140 | 175 | ○ | ○ | ○ | ○ |
| Comparative Example 3 | 140 | 180 | ○ | ○ | ○ | ○ |
| Comparative Example 4 | 140 | 175 | ○ | ○ | ○ | ○ |
| Example 2 | 140 | 200 | ○ | ○ | ○ | ○ |
| Example 3 | 140 | 200 | ○ | Δ | Δ | Δ |
| Comparative Example 5 | 140 | 200 | ○ | Δ | X | X |

This application claims priority and contains subject matter related to Japanese Patent Applications Nos. 2007-310978 and 2007-310088, both filed on Nov. 30, 2007, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A developer, comprising:

(A) an image forming toner comprising:

(i) a mother particle, comprising:

(1-a) a paraffin wax having a melting point of from 60 to 90° C.; and (1-b) a binder resin comprising a polyester resin, wherein the mother particle has an endothermic peak of the paraffin wax of from 2.0 J/g to 5.5 J/g when measured by a DSC and an aspect ratio of from 0.8 to 0.90, and wherein the mother particle has a shape factor SF-1 of from 130 to 160 and SF-2 of from 110 to 140; and (B) a carrier coated with at least one of an acrylic resin a silicone resin.

2. The developer of claim 1, wherein the carrier contains particulate alumina.

3. The developer of claim 1, wherein the mother particle is prepared by a method comprising:

(1) dispersing at least a polyester prepolymer comprising a functional group comprising a nitrogen atom, a polyester resin, a colorant, the paraffin wax, and an inorganic filler in an organic solvent, to prepare a dispersion; and (2) dispersing the dispersion in an aqueous medium to subject the polyester prepolymer to at least a crosslinking or an elongation reaction.

4. The developer of claim 3, wherein the inorganic filler is montmorillonite or modified montmorillonite.

5. The developer of claim 1, wherein the mother particle has a weight-average particle diameter of from 3 to 8 μm, and a ratio of the weight-average particle diameter to a number-average particle diameter of from 1.00 to 1.30.

6. The developer of claim 1, wherein the mother particle has a glass transition temperature of from 40 to 60° C.

7. The developer of claim 1, wherein the mother particle includes particles having a particle diameter not greater than 2 μm in an amount of from 1 to 10% by number.

8. The developer of claim 1, wherein the mother particle has an average circularity of from 0.950 to 0.980.

9. A process cartridge, comprising:

a photoreceptor;

the developer of claim 1; and at least one of a charger and a cleaner, and wherein the process cartridge is detachable from an image forming apparatus.

* * * * *